US007708531B2

(12) United States Patent
Sakikawa et al.

(10) Patent No.: US 7,708,531 B2
(45) Date of Patent: May 4, 2010

(54) AXIAL PISTON DEVICE

(75) Inventors: Shigenori Sakikawa, Hyogo (JP); Manabu Kawakami, Hyogo (JP)

(73) Assignee: Kanzaki Kokyukoki Mfg. Co., Ltd. (JP)

( * ) Notice: Subject to any disclaimer, the term of this patent is extended or adjusted under 35 U.S.C. 154(b) by 1236 days.

(21) Appl. No.: 10/931,095

(22) Filed: Sep. 1, 2004

(65) Prior Publication Data

US 2005/0053478 A1 Mar. 10, 2005

(30) Foreign Application Priority Data

Sep. 9, 2003 (JP) ..... 2003-317137

(51) Int. Cl.
*F04B 1/12* (2006.01)
*F04B 27/08* (2006.01)

(52) U.S. Cl. ..... 417/269

(58) Field of Classification Search ..... 417/269; 91/505; 92/12.2, 128, 86, 82; 60/489, 468
See application file for complete search history.

(56) References Cited

U.S. PATENT DOCUMENTS

| | | | | |
|---|---|---|---|---|
| 2,312,941 A | | 3/1943 | Tucker | |
| 2,749,941 A | | 6/1956 | Gardner | |
| 3,982,470 A | * | 9/1976 | Adams et al. | 91/506 |
| 4,031,918 A | | 6/1977 | Cagle | |
| 4,299,543 A | * | 11/1981 | Shibuya | 417/269 |

(Continued)

FOREIGN PATENT DOCUMENTS

| | | |
|---|---|---|
| JP | 63-68557 | 5/1988 |

(Continued)

OTHER PUBLICATIONS

Notification of Reasons for Rejection for corresponding Japanese patent Appl. No. 2003-317137, (with English translation) Japanese Patent Office, mailed Sep. 18, 2009, 5 pgs.

(Continued)

*Primary Examiner*—Charles G Freay
*Assistant Examiner*—Alexander B Comley
(74) *Attorney, Agent, or Firm*—Sterne, Kessler, Goldstein & Fox P.L.L.C.

(57) ABSTRACT

There is provided an axial piston device that includes a housing, a rotary shaft, a cylinder block, and a piston. The housing includes a housing body opened at a first end thereof and a plate disposed at the first end of the housing body. The rotary shaft is rotatably supported about an axis by the housing body and the plate. The cylinder block is rotated together with the rotary shaft and is accommodated inside the housing. The piston is accommodated in the cylinder block in slidable a manner in an axial direction. Furthermore, the plate is provided with a pair of first oil passages having first ends communicating with a discharge port and a suction port of the cylinder block and second ends opened to the surface of the plate, and a drain oil passage for allowing at least one of the first oil passages to communicate with an oil sump. The drain oil passage is provided with a rotary valve which can selectively switch a shutoff position at which the drain oil passage is shut off and a communication position at which the drain oil passage is communicated.

3 Claims, 16 Drawing Sheets

U.S. PATENT DOCUMENTS

| | | | | | |
|---|---|---|---|---|---|
| 4,690,036 | A | * | 9/1987 | Kosaka et al. | 91/506 |
| 4,896,506 | A | * | 1/1990 | Shivvers et al. | 60/487 |
| 4,934,253 | A | * | 6/1990 | Berthold et al. | 91/506 |
| 5,082,239 | A | | 1/1992 | Field | |
| 5,205,123 | A | * | 4/1993 | Dunstan | 60/487 |
| 5,362,208 | A | | 11/1994 | Inagaki et al. | |
| 5,363,740 | A | * | 11/1994 | Coakley | 91/499 |
| 5,372,483 | A | | 12/1994 | Kimura et al. | |
| 5,513,553 | A | * | 5/1996 | Gleasman et al. | 92/12.2 |
| 5,704,274 | A | * | 1/1998 | Forster | 92/165 R |
| 5,709,141 | A | * | 1/1998 | Ohashi et al. | 92/12.2 |
| 5,738,000 | A | * | 4/1998 | Forster | 92/165 R |
| 5,803,714 | A | * | 9/1998 | Tominaga et al. | 417/269 |
| 5,819,537 | A | * | 10/1998 | Okada et al. | 60/487 |
| 5,862,664 | A | * | 1/1999 | Ohashi et al. | 60/454 |
| 5,960,697 | A | * | 10/1999 | Hayase et al. | 92/12.2 |
| 6,068,451 | A | * | 5/2000 | Uppal | 417/222.1 |
| 6,109,032 | A | * | 8/2000 | Shimizu et al. | 60/468 |
| 6,113,359 | A | * | 9/2000 | Watts et al. | 417/269 |
| 6,119,456 | A | | 9/2000 | Louis et al. | |
| 6,227,167 | B1 | * | 5/2001 | Smith et al. | 123/446 |
| 6,233,931 | B1 | * | 5/2001 | Matsufuji | 60/487 |
| 6,311,607 | B1 | * | 11/2001 | Muller | 92/12.2 |
| 6,332,393 | B1 | * | 12/2001 | Trimble | 92/12.2 |
| 6,368,072 | B1 | * | 4/2002 | Inoue et al. | 417/269 |
| 6,390,072 | B1 | * | 5/2002 | Breeden | 123/509 |
| 6,494,686 | B1 | * | 12/2002 | Ward | 417/199.1 |
| 6,668,801 | B2 | * | 12/2003 | Smith et al. | 123/446 |
| 6,669,450 | B2 | * | 12/2003 | Jeong | 417/269 |
| 6,682,312 | B1 | * | 1/2004 | Ward | 417/199.1 |
| 6,694,729 | B1 | * | 2/2004 | Trimble | 60/444 |
| 6,793,463 | B1 | * | 9/2004 | Ward | 417/199.1 |
| 6,799,953 | B2 | * | 10/2004 | Nelson | 417/269 |
| 2005/0258388 | A1 | | 11/2005 | Loga | |
| 2006/0269421 | A1 | | 11/2006 | Sakikawa et al. | |

FOREIGN PATENT DOCUMENTS

| | | |
|---|---|---|
| JP | 07-035051 | 2/1995 |
| JP | 10-136722 | 5/1998 |
| JP | 10-248327 | 9/1998 |
| JP | 2001-263218 | 9/2001 |

OTHER PUBLICATIONS

Office Action issued Dec. 19, 2008 in U.S. Appl. No. 11/498,016, which claims priority to the present application, 10 pgs.

* cited by examiner

AXIAL PISTON DEVICE

BACKGROUND OF THE INVENTION

1. Field of the Invention

The present invention relates to an axial piston device such as a pump unit or a motor unit.

2. Related Art

An axial piston device comprising a cylinder block rotated about an axis and a piston accommodated in a slidable manner in an axial direction with respect to the cylinder block while being rotated about the axis together with the cylinder block has been widely utilized as a pump unit to be used as a hydraulic source with respect to hydraulic equipment such as a hydraulic motor or as a motor unit to be hydraulically driven by a hydraulic source such as a hydraulic pump.

Hereinafter, description will be given of a conventional axial piston device by way of a pump unit.

A conventional pump unit comprises, for example, a housing which has a housing body opened at a first end thereof and a plate attached to the first end of the housing body, a pump shaft which is supported by the housing and is driven by a drive source, and a pump body which is accommodated inside the housing and is rotatably driven by the pump shaft, wherein each of a discharge port and a suction port of the pump body is hydraulically connected in circulation to a corresponding hydraulic device such as a hydraulic motor.

That is to say, a pair of oil passages communicating with the discharge port and the suction port of the pump body, respectively, is formed at the plate. Thus, pressurized oil is supplied from the pump body to the hydraulic device via one of the oil passages, and further, return oil is returned to the pump body from the hydraulic device via the other one of the oil passages.

In the pump unit after assembly, air is mixed inside the pair of oil passages; therefore, the pair of oil passages is required to be deaerated.

In other words, the pump unit and the hydraulic device are connected via the pair of oil passages, thereby forming a circulation circuit, wherein the circulation circuit is required to be sufficiently deaerated upon filling oil into the circulation circuit.

In regard to this point, in the conventional pump unit, a drain oil passage for allowing the pair of oil passages to communicate with an oil sump is formed at the plate, and further, a shutoff valve is disposed inside the drain oil passage in such a manner as to be positionally adjusted in an axial direction (see U.S. Pat. No. 6,332,393).

In particular, a valve seat is provided at the drain oil passage. The position of the shutoff valve in the axial direction can be adjusted in such a manner that the shutoff valve can take a shutoff position at which the shutoff valve is in contact with the valve seat so as to have the drain oil passage shut off and a communication position at which the shutoff valve is apart from the valve seat in the axial direction so as to have the drain oil passage communicated.

In this conventional pump unit, the pair of oil passages can communicate with or can be cut out of the oil sump by operating the shutoff valve, with an attendant problem of impossibility of speedy switching between the communication and shutoff.

Namely, in the conventional pump unit, the position of the shutoff valve in the axial direction can be adjusted with respect to the plate owing to screw connection. Consequently, in order to move the shutoff valve from the shutoff position to the communication position at which a sufficient opening width is secured, the shutoff valve must be rotated on an axis many times.

The present invention has been accomplished in view of the above prior art. Therefore, a primary object of the present invention is to provide an axial piston device in which an oil passage can be securely and speedily deaerated.

SUMMARY OF THE INVENTION

According to one aspect of the present invention, there is provided an axial piston device that includes a housing, a rotary shaft, a cylinder block, and a piston.

The housing includes a housing body opened at a first end thereof and a plate disposed at the first end of the housing body. The rotary shaft is rotatably supported about an axis by the housing body and the plate. The cylinder block is rotated together with the rotary shaft and is accommodated inside the housing. The piston is accommodated in the cylinder block in slidable a manner in an axial direction.

Furthermore, the plate is provided with a pair of first oil passages having first ends communicating with a discharge port and a suction port of the cylinder block and second ends opened to the surface of the plate, and a drain oil passage for allowing at least one of the first oil passages to communicate with an oil sump. The drain oil passage is provided with a rotary valve which can selectively switch a shutoff position at which the drain oil passage is shut off and a communication position at which the drain oil passage is communicated.

With this configuration, since the rotary valve switches the communication/shutoff of the drain oil passage, the pair of first oil passages can be deaerated remarkably speedily with ease.

Preferably, the axial piston device further includes a pump body to be driven by the rotary shaft; and a pair of second oil passages communicating with the discharge port and the suction port of the pump body, respectively. And the axial piston device is configured that at least a part of oil, which is supplied to a hydraulic device from the discharge port of said pump body via one of said second oil passages and is returned to the suction port of said pump body via the other one of said second oil passages, is introduced into the pair of first oil passages.

With this configuration, the pair of second oil passages can be deaerated by use of the rotary valve. Consequently, the pair of second oil passages can be deaerated remarkably speedily with ease without providing any additional member.

In one embodiment of the axial piston device, the housing is configured such that an inside space is used as said oil sump, and the drain oil passage has a first end opened to the inside space of said housing.

Preferably, the axial piston device according to the one embodiment further includes a valve plate to be interposed between the plate and the cylinder block.

The valve plate is configured to allow the discharge port and the suction port of the cylinder block to communicate with the pair of the first oil passages, respectively, and support the cylinder block in a rotatable manner about the pump shaft.

The drain oil passage has a groove formed at a surface located inside the housing inside space of the plate in such a manner as to be opened toward the valve plate. The groove extends outward in a radial direction beyond the valve plate in reference to the rotary shaft.

According to the preferred embodiment, the structure of the drain oil passage can be simplified.

In the various embodiment of the axial piston device, preferably, the first oil passages are arranged in a substantially linear manner substantially symmetrically with respect to each other in reference to the rotary shaft. And the drain oil passage has a single substantially linear cross oil passage for allowing the pair of first oil passages to communicate with each other.

According to this preferred embodiment, the structure of the drain oil passage can be simplified.

According to another aspect of the present invention, there is provided an axial piston device that includes a rotary shaft rotating about an axis; a cylinder block fitted around in a non-rotatable manner relative to the rotary shaft; a piston accommodated in the cylinder block in a freely advancing/retreating manner in an axial direction; and a plate having a contact face which is brought into contact with a discharge port and a suction port of the cylinder block.

The plate is provided with a pair of first oil passages having first ends opened to the contact face in such a manner as to communicate with the discharge port and the suction port of the cylinder block, respectively, and second ends opened to the surface of the plate, and a drain oil passage for allowing at least one of the first oil passages to communicate with an oil sump.

The drain oil passage is provided with a rotary valve that can selectively switch a shutoff position at which the drain oil passage is shut off and a communication position at which the drain oil passage is communicated.

Preferably, the axial piston device according to another aspect further includes a housing surrounding the cylinder block. The housing is configured such that an inside space thereof is used as the oil sump.

In one embodiment, the housing is configured in such a manner as to surround the plate in addition to the cylinder block, and the second ends of the pair of first oil passages are fluid-connected to a conduit member supported by the housing astride inward and outward of the housing.

In another embodiment, the axial piston device further includes a housing body having an opening formed at a first end thereof. The housing body is configured to surround the cylinder block. The plate is configured in such a manner as to be connected to the housing body so as to close the opening formed at the first end of the housing body. The housing body and the plate constitute the housing.

BRIEF DESCRIPTION OF THE DRAWINGS

The above, and other objects, features and advantages of the present invention will become apparent from the detailed description thereof in conjunction with the accompanying drawings wherein.

DETAILED DESCRIPTION OF THE PREFERRED EMBODIMENTS

Embodiment 1

Hereinafter, description will be given of an axial piston device according to a preferred embodiment of the present invention with reference to the attached drawings.

An axial piston device according to this embodiment is used as a pump unit, i.e., a hydraulic source with respect to hydraulic equipment such as a hydraulic motor.

Figure 1:
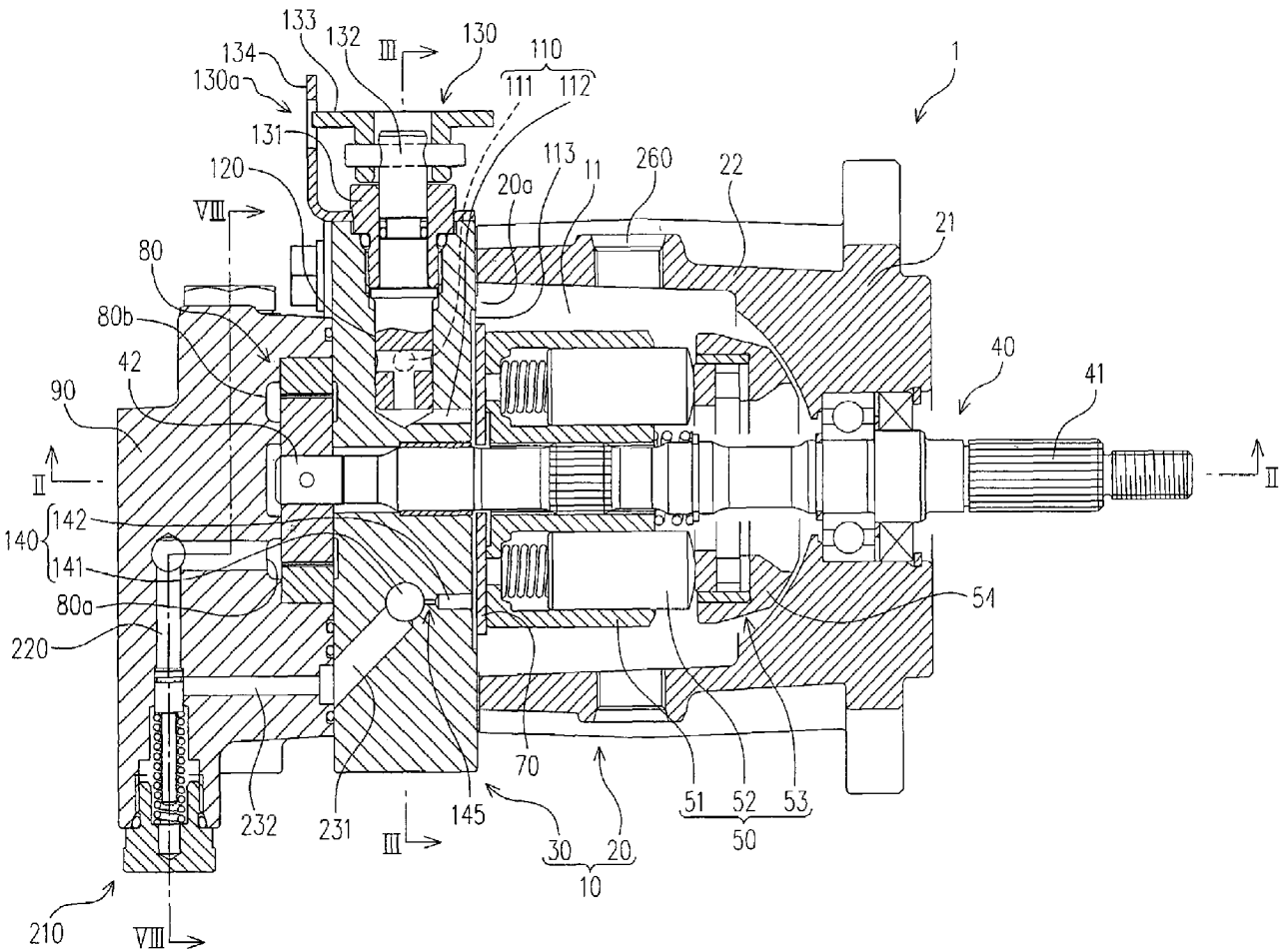
FIG. 1 is a longitudinal cross-sectional view showing an axial piston unit according to a first embodiment of the present invention.
Figure 2:
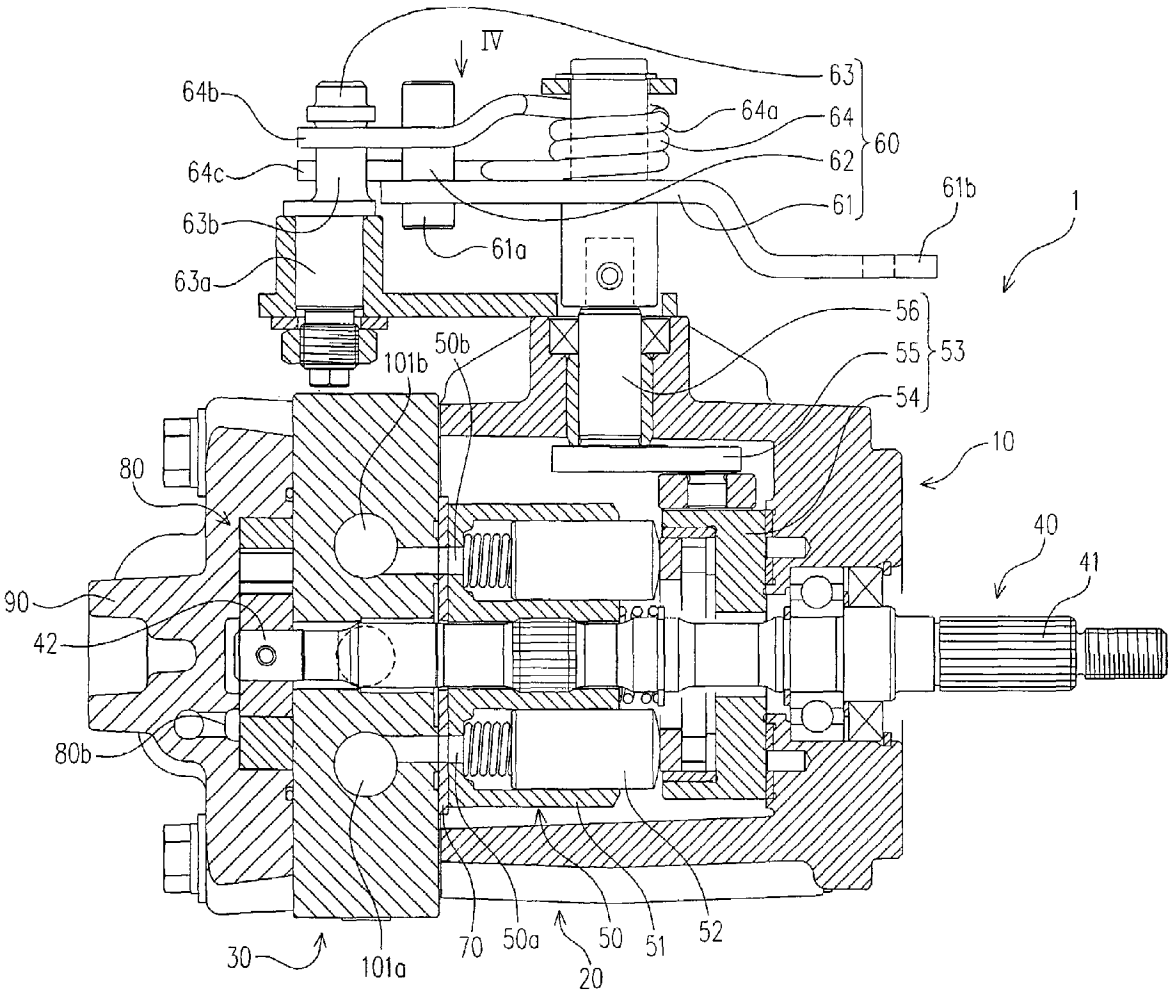
FIG. 2 is a cross-sectional view taken along a line II-II of FIG. 1.
Figure 3:
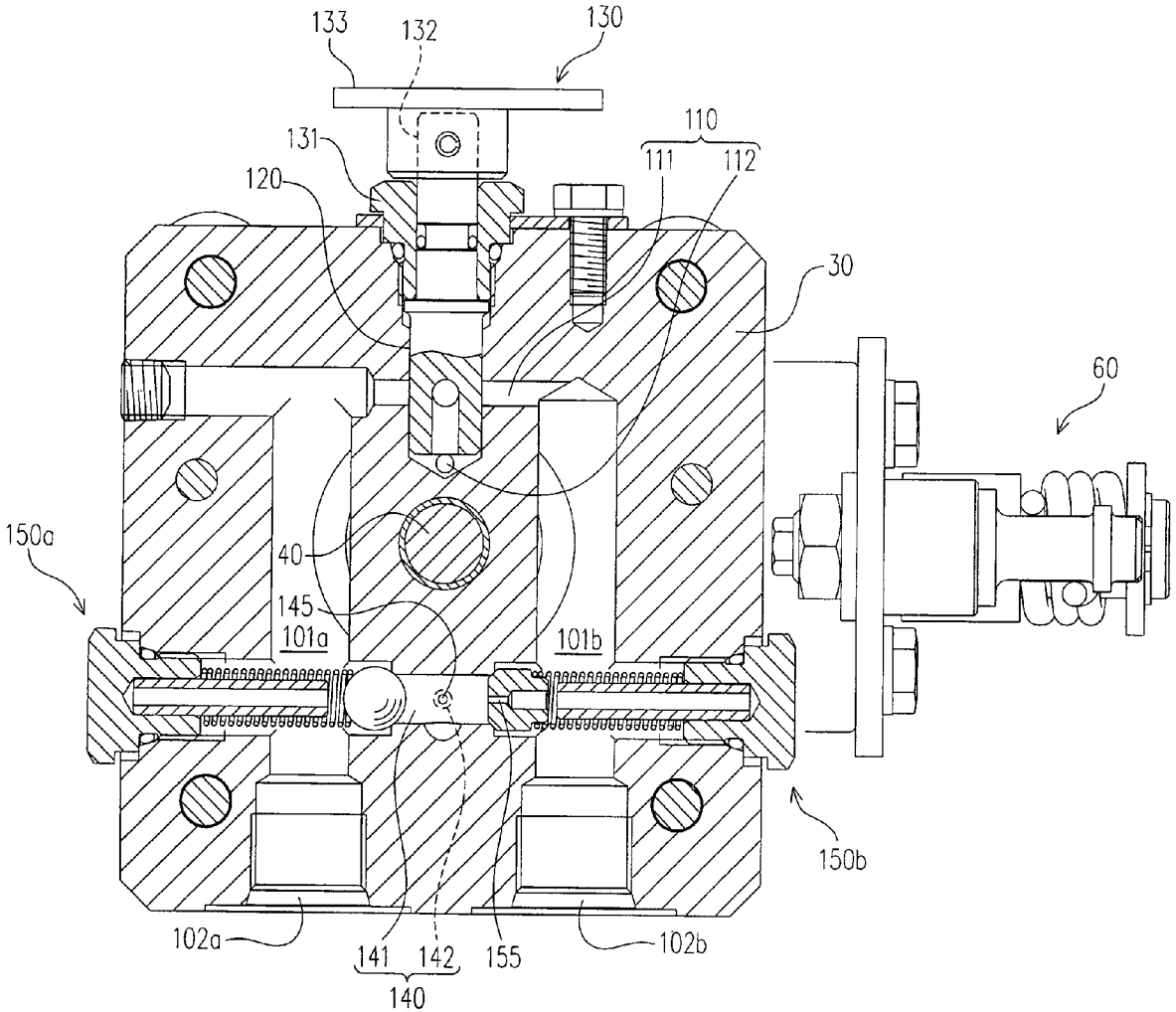
FIG. 3 is a cross-sectional view taken along a line III-III of FIG. 1.
Figure 4:
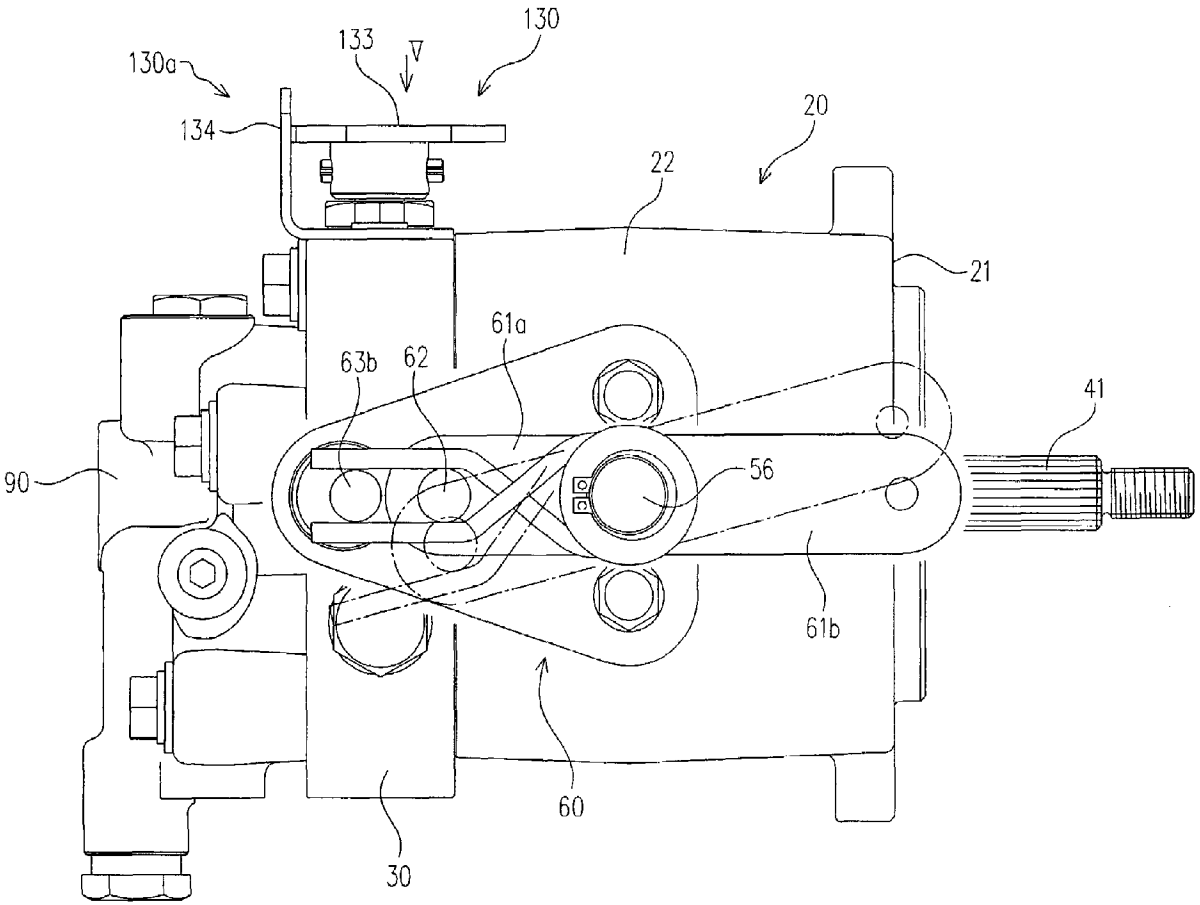
FIG. 4 is a view as viewed from an arrow IV of FIG. 2.
Figure 5:
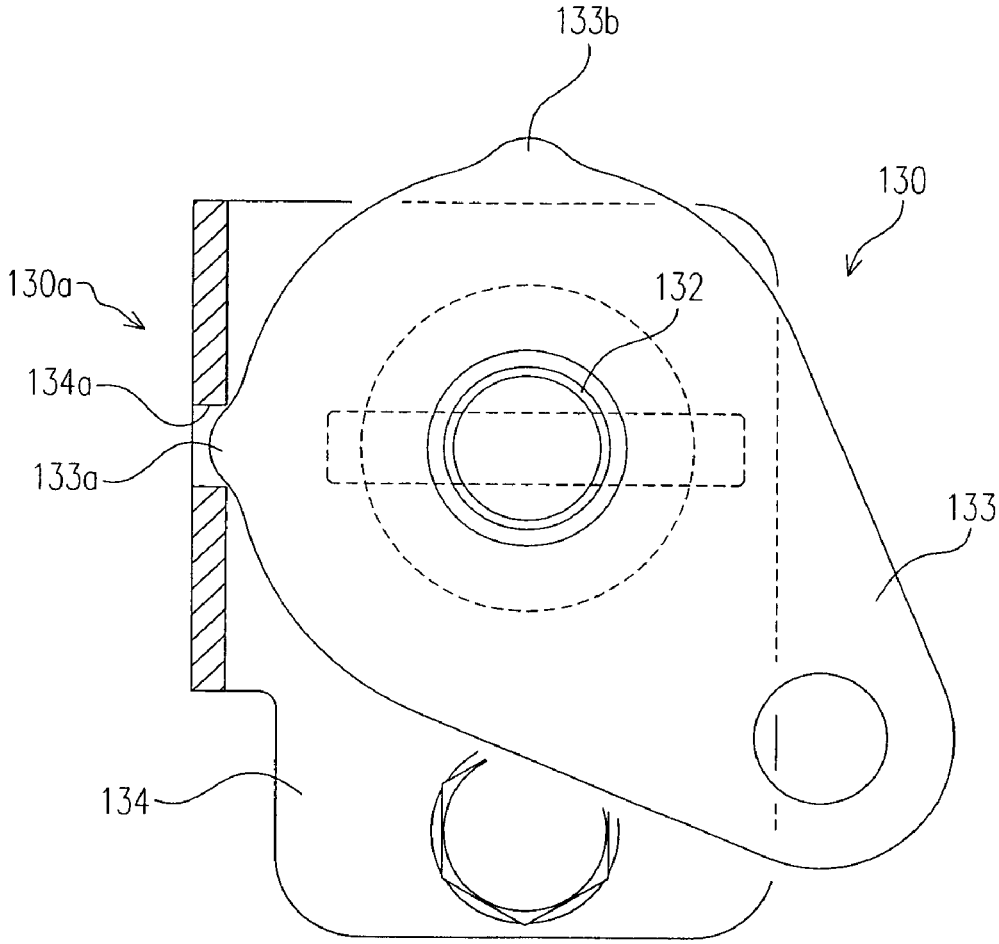
FIG. 5 is a view as viewed from an arrow V of FIG. 4.

FIG. 1 is a longitudinal cross-sectional view showing a pump unit 1 according to this embodiment. Furthermore, FIGS. 2 and 3 are a cross-sectional view taken along a line II-II of FIG. 1 and a cross-sectional view taken along a line III-III of FIG. 1, respectively. Moreover, FIGS. 4 and 5 are views as viewed from an arrow IV of FIG. 2 and an arrow V of FIG. 4, respectively.

As shown in FIGS. 1 to 3, the pump unit 1 according to this embodiment includes a housing 10, a pump shaft 40 to be operatively driven by a drive source (not shown), and a first pump body 50 to be driven by the pump shaft 40.

The housing 10 is configured in such a manner as to accommodate the first pump body 50 therein while rotatably supporting the pump shaft about an axis.

In this embodiment, the housing 10 has a hollow housing body 20 opened at a first end thereof, and a plate 30 disposed at the first end of the housing body 20.

Here, in this embodiment, the housing body 20 is bottomed by closing a second end thereof.

Specifically, the housing body 20 is provided with a side wall 21 having a positioning boss for installing a pump body, and a circumferential wall 22 extending from the peripheral edge portion of the side wall 21 toward a direction of the pump shaft.

The plate 30 is preferably configured in such a manner as to liquid-tightly close an opening 20*a* at the first end of the housing body 20, and therefore, an inside space 11 of the housing 10 can be used as an oil sump.

The pump shaft 40 is rotatably supported on an axis by the housing body 20 and the plate 30 in a state in which an input end extends outward in such a manner as to be operatively connected to the drive source.

In the pump shaft 40 in this embodiment, a first end 41 located upstream in a transmission direction (i.e., a right end in FIGS. 1 and 2) extends outward of the side wall 21 of the housing body 20, and further, a second end 42 located downstream in the transmission direction (i.e., a left end in FIGS. 1 and 2) also extends outward of the plate 30.

Incidentally, a second pump body 80, described later, is supported at the second end 42 located downstream in the transmission direction of the pump shaft 40.

The first pump body 50 is accommodated inside the housing 10 in such a state as to be freely driven by the pump shaft 40.

The first pump body 50 in this embodiment is configured in a variable displacement type in which a suction/discharge oil rate can be varied according to a slanting position of an output adjusting member 53.

In particular, the first pump body 50 includes a cylinder block 51 supported by the pump shaft 40 in a relatively non-rotatable manner, a piston 52 slidable in the pump shaft direction with respect to the cylinder block 51 while rotating on the pump shaft 40 together with the cylinder block 51, and the output adjusting member 53.

The output adjusting member 53 is provided with a movable swash plate 54 defining a sliding range in the pump shaft direction of the piston 52 according to a position of the piston unit 52 around the pump shaft 40, a connecting arm 55 having a first end connected to the movable swash plate 54, and a control shaft 56 supported by the housing 10 in a rotatable manner on the axis so as to have a first end connected to a second end of the connecting arm 55 and have a second end located outward of the housing 10.

An operating arm 61 is connected to the second end of the control shaft 56, and thus, the control shaft 56 is rotated on the axis by oscillating the operating arm 61 on the axis of the control shaft 56.

As shown in FIGS. 2 to 4, the first pump body 50 in this embodiment includes a neutral position returning mechanism 60 for returning the movable swash plate 54 to a neutral position.

The neutral position returning mechanism 60 is provided with the operating arm 61, a locking pin 62 disposed at a first end 61*a* of the operating arm 61, a fixed pin 63 fixedly disposed at the housing 10, and a coil spring 64 wound around the outer portion of the control shaft 56.

A second end 61*b* of the operating arm 61 functions as an operating portion. That is to say, the control shaft 56 is rotated about its axis by oscillating the second end 61*b* of the operating arm 61 about the control shaft 56, so that the movable swash plate 54 is slanted.

The coil spring 64 includes a central portion 64*a* wound around the outer portion of the control shaft 56, and a first end 64*b* and a second end 64*c* extending from the central portion 64*a*. The fixed pin 63 and the locking pin 62 are held between the first end 64*b* and the second end 64*c* of the coil spring 64.

With this configuration, the fixed pin 63 is adapted to position the movable swash plate 54 at the neutral position in a state in which no operating force is applied to the operating arm 61 from the outside. In other words, the fixed pin 63 functions as a neutral position setting member defining the neutral position of the movable swash plate 54.

Particularly, when the operating arm 61 is oscillated toward one side about the control shaft 56, the movable swash plate 54 is oscillated in a corresponding direction according to the rotation of the control shaft 56 about the axis, and further; the locking pin 62 is also oscillated toward one side about the control shaft.

When the locking pin 62 is oscillated in the above manner, the coil spring 64 is oscillated at only the first end 64*b* toward one side about the control shaft 56 in a state in which the second end 64*c* is held by the fixed pin 63, whereby the coil spring 64 retains its resiliency.

Therefore, when the operating force exerted on the operating arm 61 is released, the locking pin 62 and the operating arm 61 are returned to the neutral position by the resiliency retained by the coil spring 64, and accordingly, the movable swash plate 54 is returned to the neutral position.

Preferably, the neutral position returning mechanism 60 may be configured such that the position of the fixed pin 63 can be adjusted relative to the axis position of the control shaft 56.

In particular, the fixed pin 63 can have an eccentric structure. Namely, the fixed pin 63 can be configured to include a first portion 63*a*, at which the position relative to the axial position of the control shaft 56 is made invariable, and a second portion 63*b*, which is eccentric from the first portion 63*a* and is held between the first end 64*b* and the second end 64*c* of the coil spring 64.

With this configuration, the position of the second portion 63*b* relative to the axial position of the control shaft 56 can be readily varied by rotating the first portion 63*a* about the axis.

Consequently, the position of the second portion 63*b* relative to the axial position of the control shaft 56 can be easily adjusted to a proper position corresponding to the neutral position of the movable swash plate 54.

Although the first pump body 50 is of a variable displacement type in this embodiment, it may be of a fixed displacement type. If the first pump body 50 is of a fixed displacement type, a fixed swash plate is replaced with the output adjusting member 53.

Next, description will be given of a hydraulic circuit in the pump unit 1 according to this embodiment.

Figure 6:
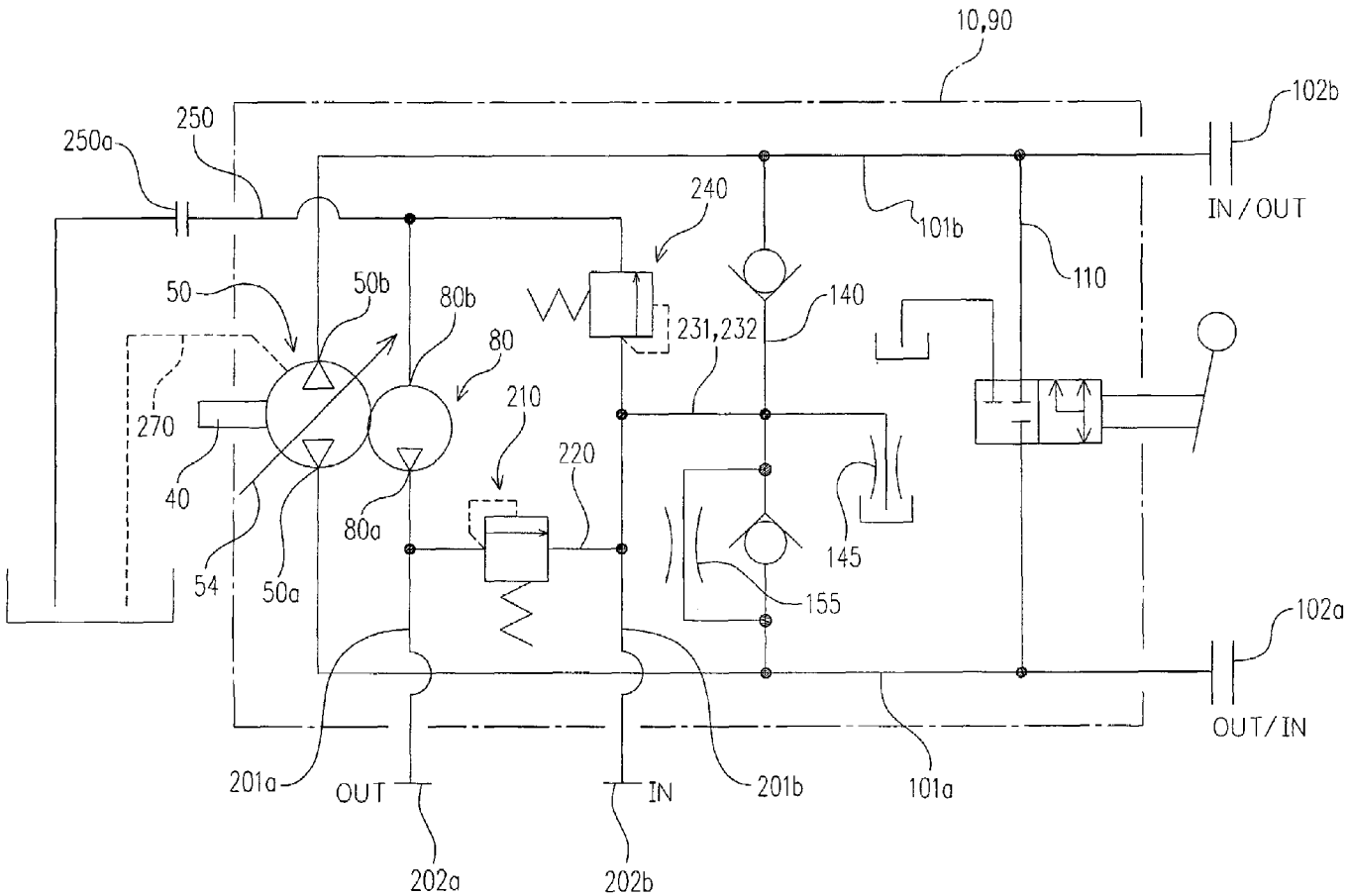
FIG. 6 is a diagram illustrating a hydraulic circuit of the axial piston unit shown in FIGS. 1-5.

FIG. 6 is a diagram illustrating a hydraulic circuit of the pump unit 1 according to this embodiment.

As illustrated in FIGS. 3 and 6, the plate 30 is provided with a pair of first oil passages 101*a*, 101*b* which have first ends forming kidney ports so as to communicate with a discharge port 50*a* and a suction port 50*b* of the first pump body 50, respectively, and a drain oil passage 110 for allowing the pair of first oil passages 101*a*, 101*b* to communicate with the oil sump.

Each of the pair of first oil passages 101*a*, 101*b* has a second end opened to the outer surface of the plate 30. The opening ends constitute pressurized oil supplying/discharging ports 102*a*, 102*b* for communicating with a hydraulic device such as a hydraulic motor in cooperation with the pump unit 1.

The first oil passages 101*a*, 101*b* are arranged in a substantially linear manner substantially symmetrically with each other in reference to the pump shaft 40 in this embodiment, as shown in FIG. 3.

The drain oil passage 110 has a first end communicating with at least one of the first oil passages 101*a*, 101*b*, and a second end communicating with the oil sump.

In this embodiment, the drain oil passage 110 includes a single substantially linear cross oil passage 111 for allowing the pair of first oil passages 101*a*, 101*b* to communicate with each other, and a connecting oil passage 112 having a first end communicating with the cross oil passage 111 and a second end opened to the surface of the plate 30, as shown in FIGS. 1 and 3.

As described above, in this embodiment, the inside space 11 of the housing 10 commonly serves as the oil sump. Consequently, the second end of the connecting oil passage 112 is opened to an inner surface facing to the housing inside space 11 of the plate 30.

Here, to the inner surface of the plate 30 is opened also the pair of first oil passages 101*a*, 101*b* in addition to the drain oil passage 110.

The pump unit 1 according to this embodiment adopts a configuration below in order to prevent any interference of the pair of first oil passages 101*a*, 101*b* and the drain oil passage 110 and to allow these oil passages to communicate with the housing inside space 11.

Figure 7:
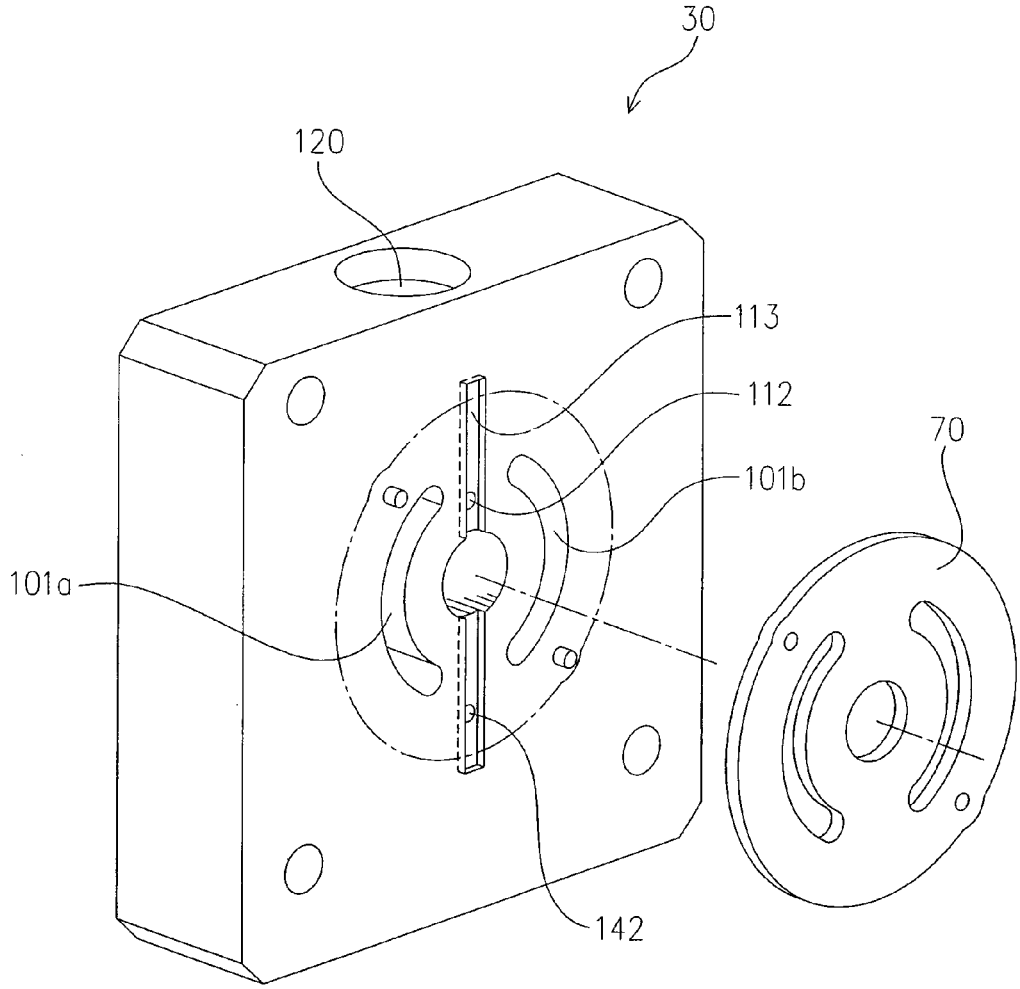
FIG. 7 is a perspective view showing a plate of the axial piston unit shown in FIGS. 1-6, as viewed from the inner surface

FIG. 7 is a perspective view showing the plate 30, as viewed from the inner surface.

As shown in FIGS. 1, 2 and 7, the pump unit 1 according to this embodiment includes a valve plate 70 interposed between the plate 30 and the first pump body 50.

The valve plate 70 is configured such that it can rotatably support the cylinder block 51, and further, that it allows the discharge port 50*a* and the suction port 50*b* of the first pump body 50 to communicate with the first ends of the first oil passages 101*a*, 101*b*, respectively.

At the inner surface of the plate 30, a groove 113 is formed in such a manner as to be opened toward the valve plate 70. The groove 113 extends outward in a radial direction beyond the valve plate 70 in reference to the pump shaft 40.

With this configuration, the second end of the connecting oil passage 112 is opened to the groove 113.

Namely, in this embodiment, the drain oil passage 110 also includes the groove 113 in addition to the cross oil passage 111 and the connecting oil passage 112.

Most part of the groove 113 except for an outer end in a radial direction is designed to be closed by the back surface of the valve body 70 (i.e., a surface in contact with the plate 30) when the valve plate 70 is disposed at the inner surface of the plate 30. As a consequence, a simple structure can allow the drain oil passage 110 to communicate with the oil sump, i.e., the housing inside space 11 without exerting any adverse influence on the oil supplying/discharging function of the cylinder block 51 while preventing the interference with the pair of oil passages 101*a*, 101*b* and the drain oil passage 110.

As shown in FIGS. 1 and 3, a disposing hole 120, which has a first end opened to the outer surface of the plate 30 and a second end communicating with the drain oil passage 110, is formed at the plate 30 in addition to the above-described various oil passages.

Furthermore, a rotary valve 130 is inserted into the disposing hole 120 in a rotatable manner about its axis in the state in which the outer end extends outward of the plate 30.

The rotary valve 130 shuts off the drain oil passage 110 when it is located at a predetermined shutoff position about the axis with respect to the disposing hole 120 (see FIG. 3); in contrast, it allows the communication of the drain oil passage 110 when it is located at a communication position at which it is rotated about the axis by a predetermined angle from the shutoff position.

In other words, the rotary valve 130 is switchably operated between the shutoff position and the communication position according to the position about the axis with respect to the disposing hole 120.

Incidentally, in this embodiment, the shutoff position and the communication position can be selectively switched by rotating the rotary valve 130 at 90° about the axis.

Moreover, in this embodiment, the rotary valve 130 includes a detent mechanism 130*a* which holds the rotary valve 130 at the shutoff position and the communication position.

That is to say, a seal cap 131 coaxial with the disposing hole 120 is screwed at the disposing hole 120 opened to one side end face of the plate 30, and an operating shaft 132 of the rotary valve 130 projects outward of the seal cap 131 and is provided with a handle 133.

Additionally, at the outer edge of the handle 133 are formed two projections 133*a*, 133*b* having the same shape as each other at an interval of 90° in a circumferential direction, as shown in FIG. 5.

Furthermore, a positioning plate 134 having a substantial L-shape as viewed in cross section is disposed at the one side end face of the plate 30. The positioning plate 134 includes a lateral plate portion in contact with the one side end face of the plate 30 and a vertical plate portion extending from the lateral plate portion along the axial direction of the rotary valve 130. At the vertical plate portion is formed a recess 134*a* into which the projection 133*a* or 133*b* can be fitted.

The detent mechanism 130*a* is configured in the above-described manner. Therefore, the projection 133*a* is fitted into the recess 134*a* when the rotary valve 130 is located at the shutoff position, so that the handle 133 is held at that position; in contrast, the projection 133*b* is fitted into the recess 134*a* when the rotary valve 130 is located at the communication position, so that the handle 133 is held at that position.

In the pump unit 1 having this configuration, the pair of first oil passages 101*a*, 101*b* can be remarkably speedily and readily deaerated in comparison with the conventional pump unit.

In the prior art in which the shutoff and communication of the drain oil passage are switched by moving the shutoff valve screwed into the plate in the axial direction, a communication opening width of the drain oil passage cannot be sufficiently secured unless the shutoff valve is rotated about the axis several times.

Furthermore, with this conventional configuration, the valve seat is required to be disposed at a deep portion of the oil passage into which the shutoff valve is screwed.

In contrast, in the pump unit 1 according to this embodiment, the shutoff and communication of the drain oil passage 110 can be switched without rotating the rotary valve 130 once about the axis (only by rotation at 90° in this embodiment), and thus, the pair of first oil passages 101*a*, 101*b* can be remarkably speedily deaerated.

Furthermore, in this embodiment, no valve seat is required to be disposed, unlike the prior art, and therefore, the drain oil passage 110 can be readily bored.

Moreover, in the pump unit 1 according to this embodiment, a charge oil passage 140 for supplying charge oil to the pair of first oil passages 101*a*, 101*b* is formed at the plate 30, as illustrated in FIGS. 3 and 6.

The charge oil passage 140 includes a first bypass oil passage 141 for allowing the pair of first oil passages 101*a*, 101*b* to communicate with each other, and a suction oil passage 142 which has a first end connected to the first bypass oil passage 141 and a second end communicating with the housing inside space 11.

Check valves 150*a*, 150*b* for allowing an oil flow from the suction oil passage 142 to the pair of first oil passages 101*a*, 101*b* and preventing a reverse oil flow are interposed between a connecting point of the first bypass oil passage 141 to the suction oil passage 142 and the pair of first oil passages 101*a*, 101*b*, respectively.

In this embodiment, a throttle 155 is disposed in the check valve 150*b* interposed between the first oil passage 101*b* of the first oil passages 101*a*, 101*b* and the charge oil passage 140, thereby increasing a neutral width of the first pump body 50.

Additionally, a self-sucking throttle 145 in the case where either one of the first oil passages 101*a*, 101*b* becomes low in pressure due to oil leakage is provided on the charge oil passage 140. The inside of each of the first oil passages 101*a*, 101*b* can be kept in a state full of oil all the time by providing the throttle 145. As a consequence, in the case where the pump unit 1 according to the present invention is used as, for example, a drive source for a vehicle traveling hydraulic motor, there is no danger that a vehicle cannot be rolled down toward a ravine even if the vehicle is parked on a slope without applying parking brake.

Here, in this embodiment, the second end of the suction oil passage 142 is opened to the groove 113. As described above, most part of the groove 113 except for the outer end in the radial direction is closed by the valve plate 70. As a consequence, the simple structure can allow the suction oil passage 142 to communicate with the housing inside space 11 without exerting any adverse influence on the oil supplying/discharging function of the cylinder block 51 while preventing the interference with the pair of first oil passages 101*a*, 101*b* and the drain oil passage 110.

In addition to the above configurations, the pump unit 1 according to this embodiment includes the second pump body 80 to be driven by the pump shaft 40, and a pair of second oil passages 201*a*, 201*b* communicating with a discharge port 80*a* and a suction port 80*b* of the second pump body 80, respectively.

The second pump body 80 is adapted to supply pressurized oil to the hydraulic device in cooperation with the first pump body 50 or another hydraulic device other than the hydraulic device.

In this embodiment, the second pump body 80 is supported at the second end 42 downstream in the transmission direction of the pump shaft 40 (i.e., the left end in FIGS. 1 and 2).

Figure 8:
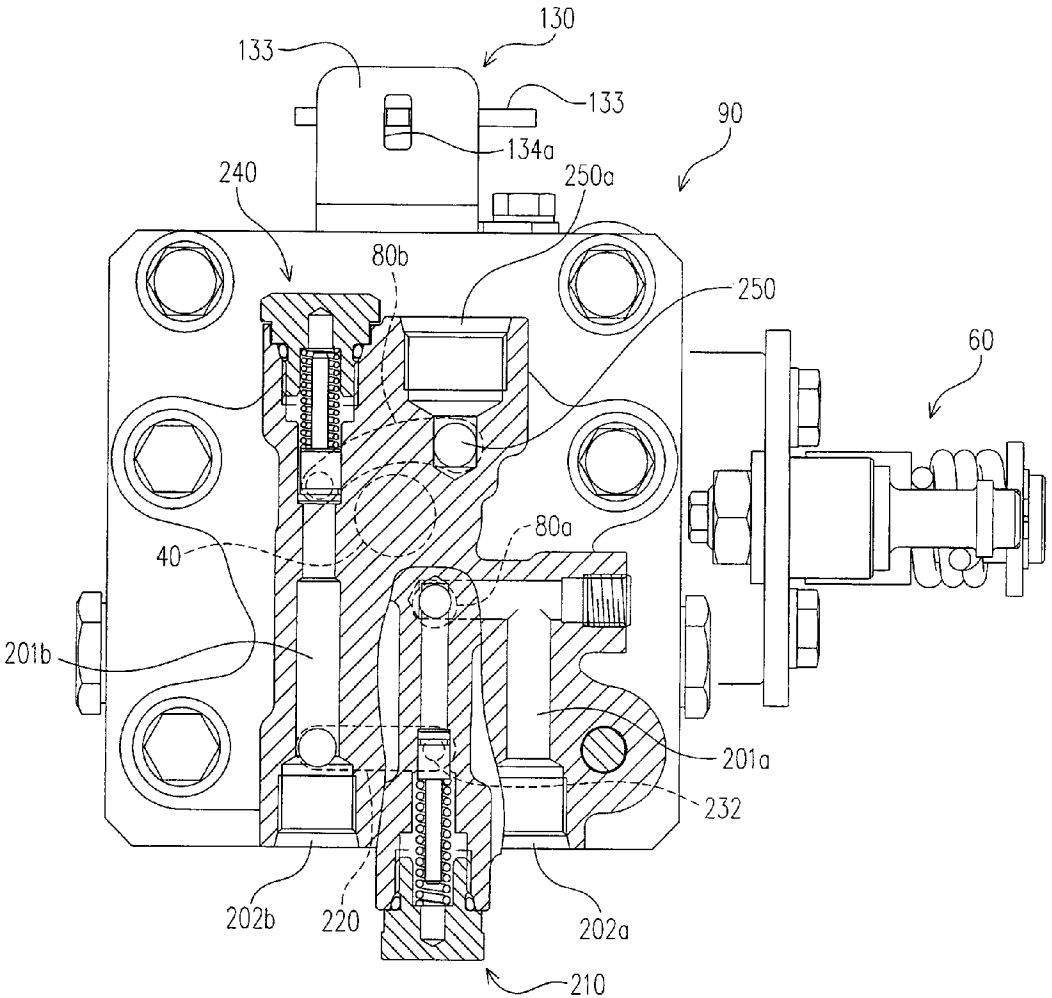
FIG. 8 is a cross-sectional view taken along a line VIII-VIII of FIG. 1.

FIG. 8 is a cross-sectional view taken along a line VIII-VIII of FIG. 1.

As shown in FIGS. 1 to 8, the pair of second oil passages 201*a*, 201*b* is bored in a pump case 90 surrounding the second pump body 80.

That is to say, the pump unit 1 according to this embodiment includes the pump case 90 connected to an outer surface on a side opposite to the inner surface of the plate 30 in such a manner as to surround the second pump body 80. The pair of second oil passages 201*a*, 201*b* is formed in the pump case 90.

In particular, the second oil passages 201*a*, 201*b* have first ends communicated with the discharge port 80*a* and the suction port 80*b* of the second pump body 80, respectively, second ends opened to the surface of the pump case 90, thereby forming a discharge port 202*a* and a suction port 202*b*, respectively.

As shown in FIGS. 6 and 8, a relief valve 210 for setting an operating oil pressure for the hydraulic device in cooperation with the second pump body 80 is inserted into the positive pressure oil passage 201*a* communicating with the discharge port 80*a* of the second pump body 80 out of the pair of second oil passages 201*a*, 201*b*.

In this embodiment, a bypass oil passage 220 for allowing the second oil passages 201*a*, 201*b* to communicate with each other is formed in the pump case 90, and thus, the relief valve 210 is inserted into the bypass oil passage 220.

In contrast, the negative pressure oil passage 201*b* communicating with the suction port 80*b* in the second pump body 80 out of the pair of second oil passages 201*a*, 201*b* is connected to the pair of first oil passages 101*a*, 101*b*.

Namely, at least a part of the oil, which is supplied from the discharge port 80*a* of the second pump body 80 to the hydraulic device via one of the second oil passages (i.e., the positive pressure oil passage 201*a*) and is returned to the suction port 80*b* of the second pump body 80 via the other one of the second oil passages (i.e., the negative pressure oil passage 201*b*), is designed to be introduced to the pair of first oil passages 101*a*, 101*b*, thereby speedily deaerating the pair of second oil passages 201*a*, 201*b* by use of the rotary valve 130.

In this embodiment, the plate 30 includes a first connecting oil passage 231 which has a first end communicating with the charge oil passage 140 and a second end opened to the surface in contact with the pump case 90, as shown in FIG. 1.

Furthermore, the pump case 90 is provided with a second connecting oil passage 232 which has a first end communicating with the negative pressure oil passage 201*b* and a second end opened to the surface in contact with the plate 30, so as to communicate with the first connecting oil passage 231.

In other words, the negative pressure oil passage 201*b* is designed to communicate with the pair of first oil passages 101*a*, 101*b* via the second connecting oil passage 232, the first connecting oil passage 231 and the charge oil passage 140.

Moreover, a charge relief valve 240 for setting an oil pressure of the pressurized oil flowing to the charge oil passage 140 from the negative pressure oil passage 201*b* is inserted into the negative pressure oil passage 201*b*.

Additionally, in the pump case 90 is formed a suction oil passage 250 which has a first end opened to the surface so as to form a suction port 250*a* and a second end communicating with the negative pressure oil passage 201*b*.

Incidentally, reference numeral 260 in FIG. 1 designates a drain port for draining the oil reserved inside the housing inside space 11.

In addition, reference numeral 270 in FIG. 6 designates a leak oil passage from the first pump body 50 to the oil sump (i.e., the housing inside space 11 in this embodiment).

Embodiment 2

Hereinafter, description will be given of an axial piston device according to another preferred embodiment of the present invention with reference to the attached drawings.

An axial piston device 1B according to this embodiment is also configured to be used as a pump unit in the same manner as in the first embodiment.

Figure 9:
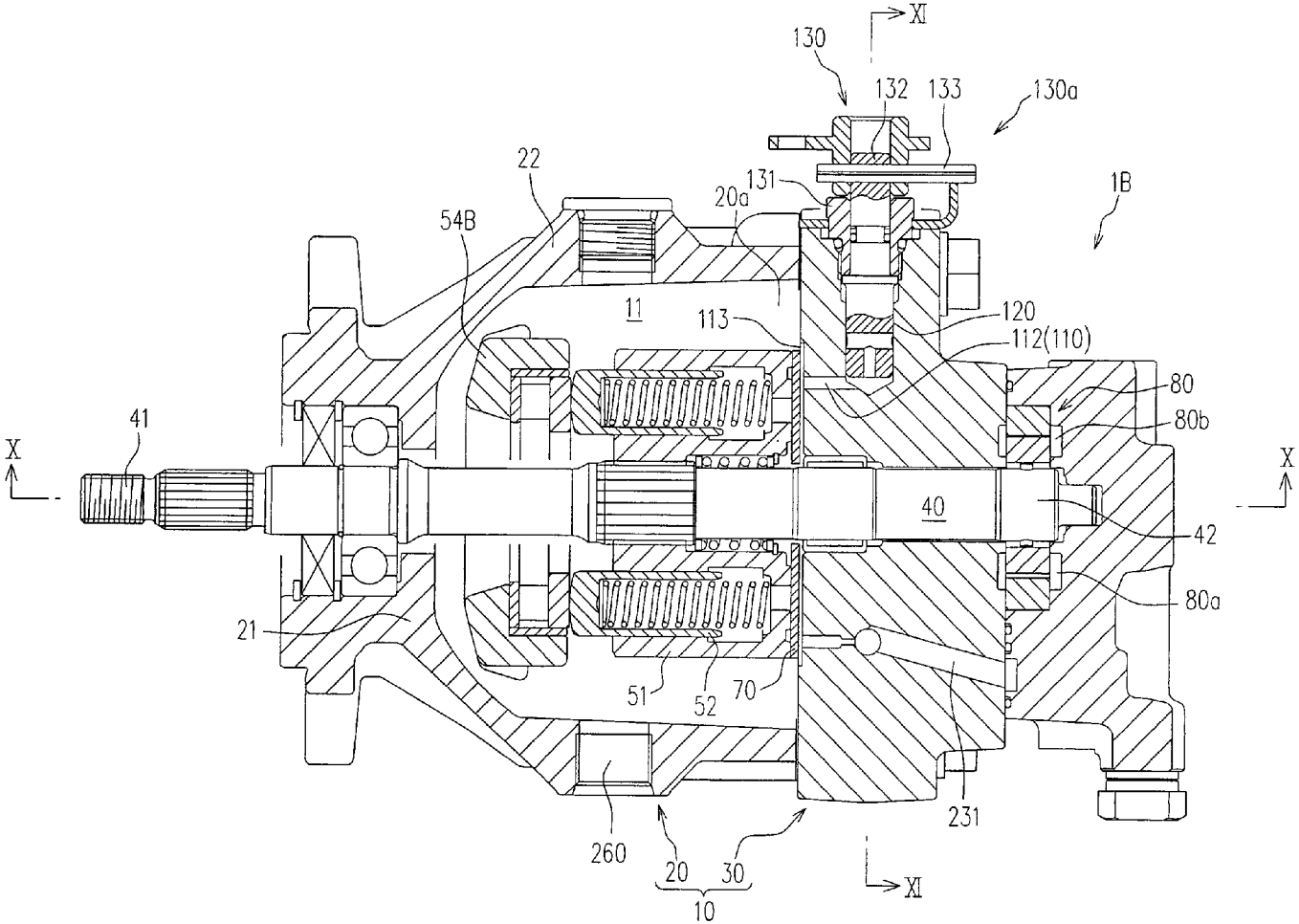
FIG. 9 is a longitudinal cross-sectional view showing an axial piston unit according to a second embodiment of the present invention.
Figure 10:
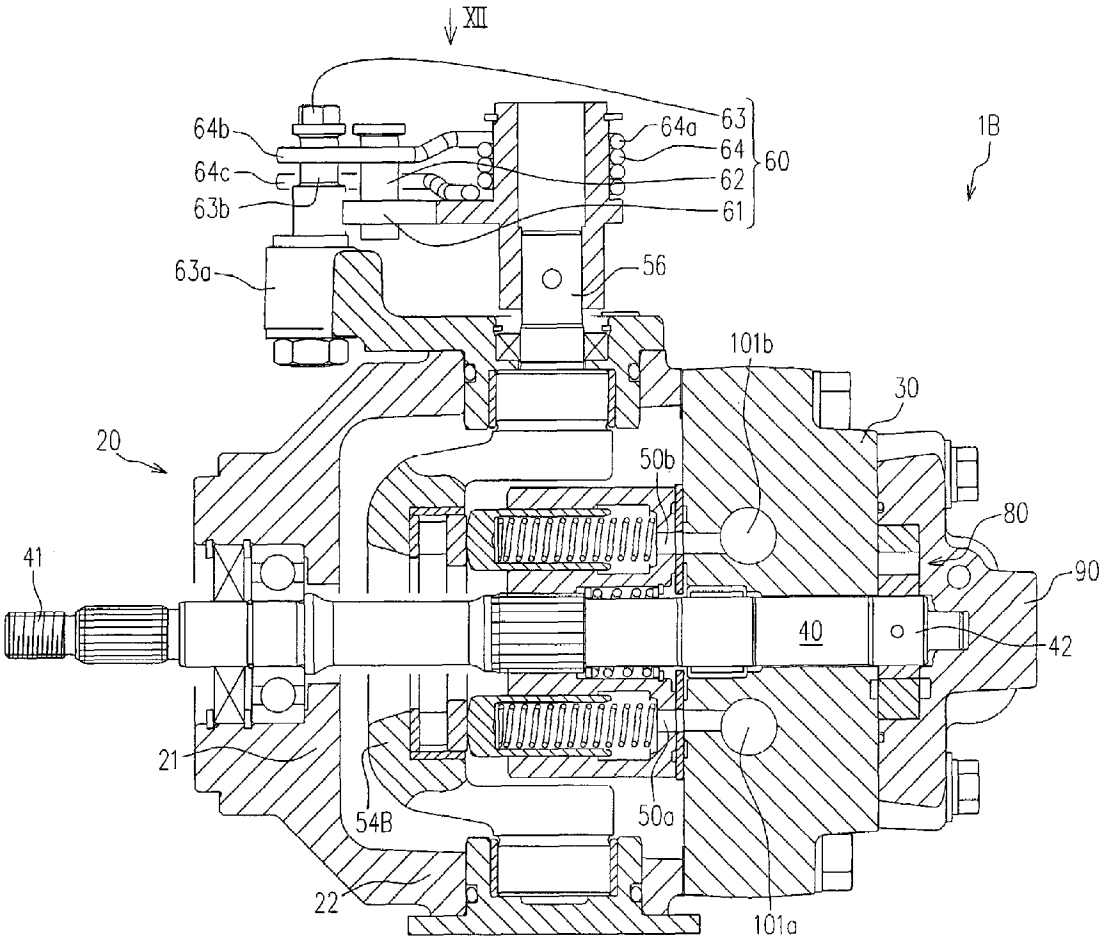
FIG. 10 is a cross-sectional view taken along a line X-X of FIG. 9.
Figure 11:
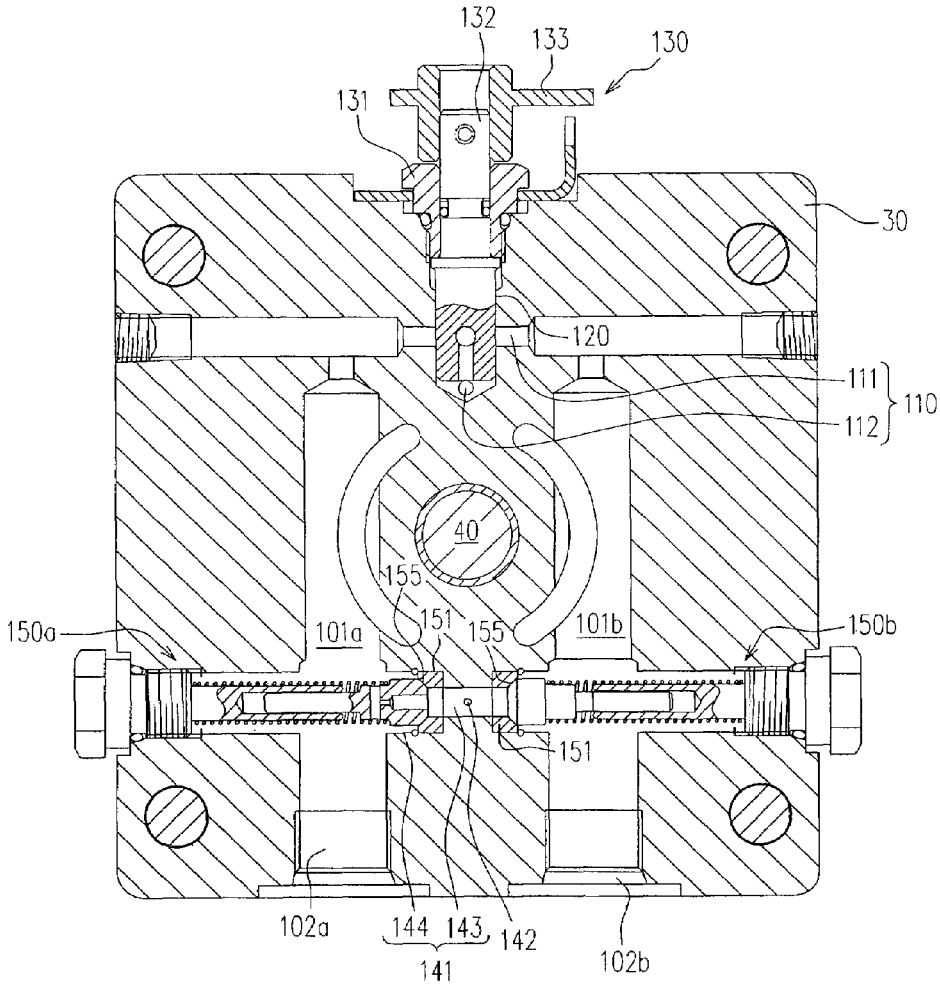
FIG. 11 is a cross-sectional view taken along a line XI-XI of FIG. 9.
Figure 12:
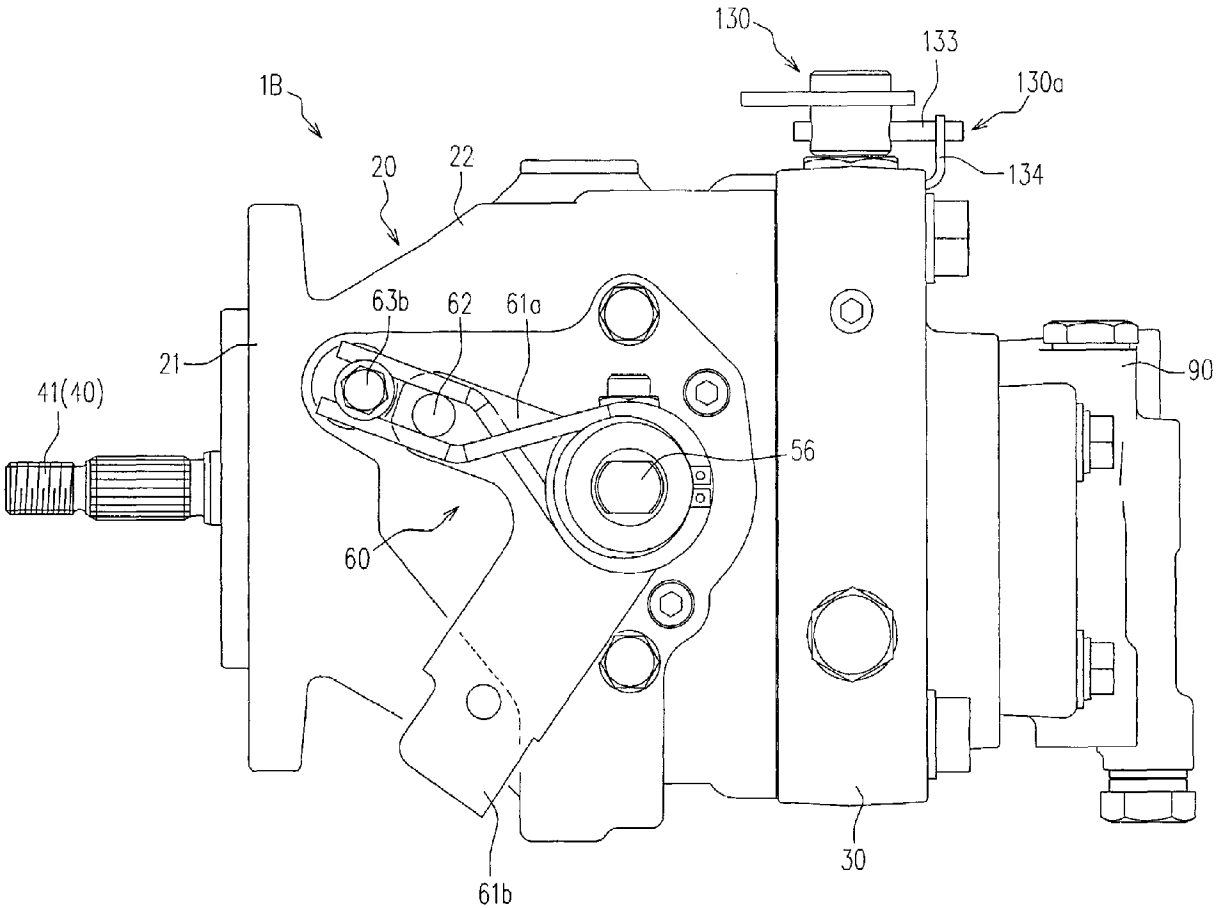
FIG. 12 is a view as viewed from an arrow XII of FIG. 10.

FIG. 9 is a longitudinal cross-sectional view showing the pump unit 1B according to this embodiment. Furthermore, FIGS. 10 and 11 are a cross-sectional view taken along a line X-X of FIG. 9 and a cross-sectional view taken along a line XI-XI of FIG. 9, respectively. Moreover, FIG. 12 is a view as viewed from an arrow XII of FIG. 10.

Here, in FIGS. 9 to 12, the same or corresponding components as or to those in the first embodiment are designated by the same reference numerals; therefore, the detailed description for those components will not be given herein.

The pump unit 1B according to this embodiment is configured in substantially the same manner as that in the first embodiment except that the movable swash plate 54 in the pump unit 1 in the first embodiment is replaced with a trunnion-type movable swash plate 54B and that the seat faces of the check valves 150*a*, 150*b* are constituted of components independent of the plate 30.

In particular, the pump unit 1B includes the trunnion-type movable swash plate 54B in place of the movable swash plate 54, as shown in FIGS. 9 and 10.

The above-described movable swash plate 54B of a trunnion type has small sliding resistance, so that the movable swash plate 54B can be speedily returned to a neutral position of the movable swash plate 54B by means of the neutral position returning mechanism 60.

Furthermore, the pump unit 1B includes a pair of seat members 151 to be inserted into the first bypass oil passage 141.

More particularly, the first bypass oil passage 141 includes a small-diameter portion 143 communicating with the suction oil passage 142 and a pair of large-diameter portions 144 whose diameter is enlarged with steps continuous from the small-diameter portion 143 and which communicates with the pair of first oil passages 101*a*, 101*b*, respectively, as shown in FIG. 11.

The pair of seat members 151 are disposed inside the large-diameter portions 144, respectively, so that each seat face 155 is oriented toward the corresponding first oil passages 101*a*, 101*b*.

Incidentally, the seat member 151 is fixed to the large-diameter portion 144 by, for example, a stopper ring (see FIG. 11) or press-fitting.

In this manner, a repairing work in the case of degradation of the seat face 155 can be readily performed at low cost by forming the seat face 155 of a member independent of the plate 30 (the seat member 151 in this embodiment).

In a situation in which the first pump body 50 is operated for a long period of time in the state of, for example, application of a high load, the check valves 150*a*, 150*b* are frequently opened and closed, whereby the seat face 155 is abraded, thereby inducing a possibility of leakage of operating oil from the pair of first oil passages 101*a*, 101*b*.

Especially in the case where the plate 30 is made of aluminum, the possibility of leakage is tended to become stronger.

In such a case, the seat face 155 can be repaired by only replacing the seat member 151, if the seat face 155 is formed of a member independent of the plate 30, like in this embodiment.

Figure 13:
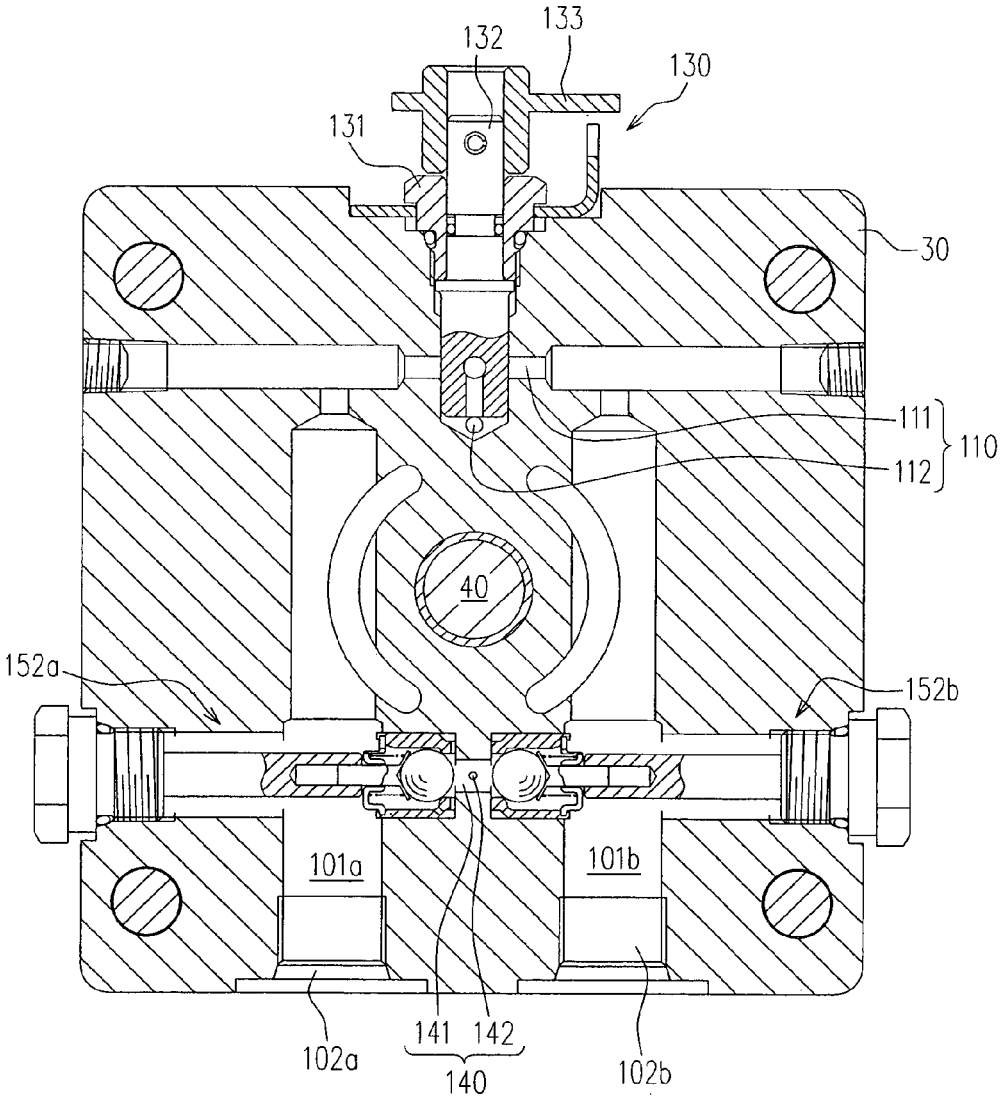
FIG. 13 is a cross-sectional view of a plate of a modified axial piston unit shown in FIGS. 9-13.

FIG. 13 is a cross-sectional view showing the plate 30 provided with cartridge-type check valves 152*a*, 152*b*.

As described above, the seat member 151 provided with the seat face 155 is used in this embodiment. Alternatively, there may be provided the cartridge-type check valves 152*a*, 152*b* each including a valve case having a seat face 155, as shown in FIG. 13.

Embodiment 3

Hereinafter, description will be given of an axial piston device according to still another preferred embodiment of the present invention with reference to the attached drawings.

Figure 14:
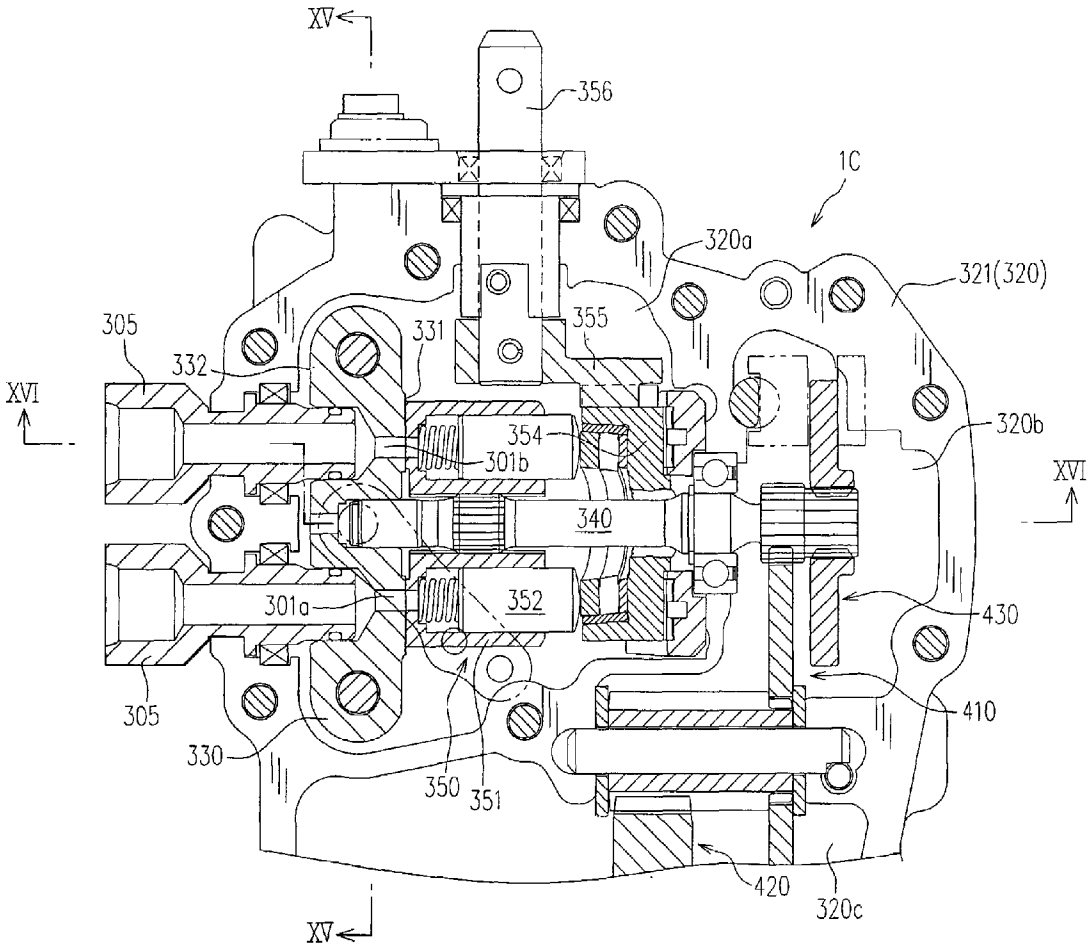
FIG. 14 is a laterally partial plan view showing an axial piston device according to a third embodiment of the present invention.
Figure 15:
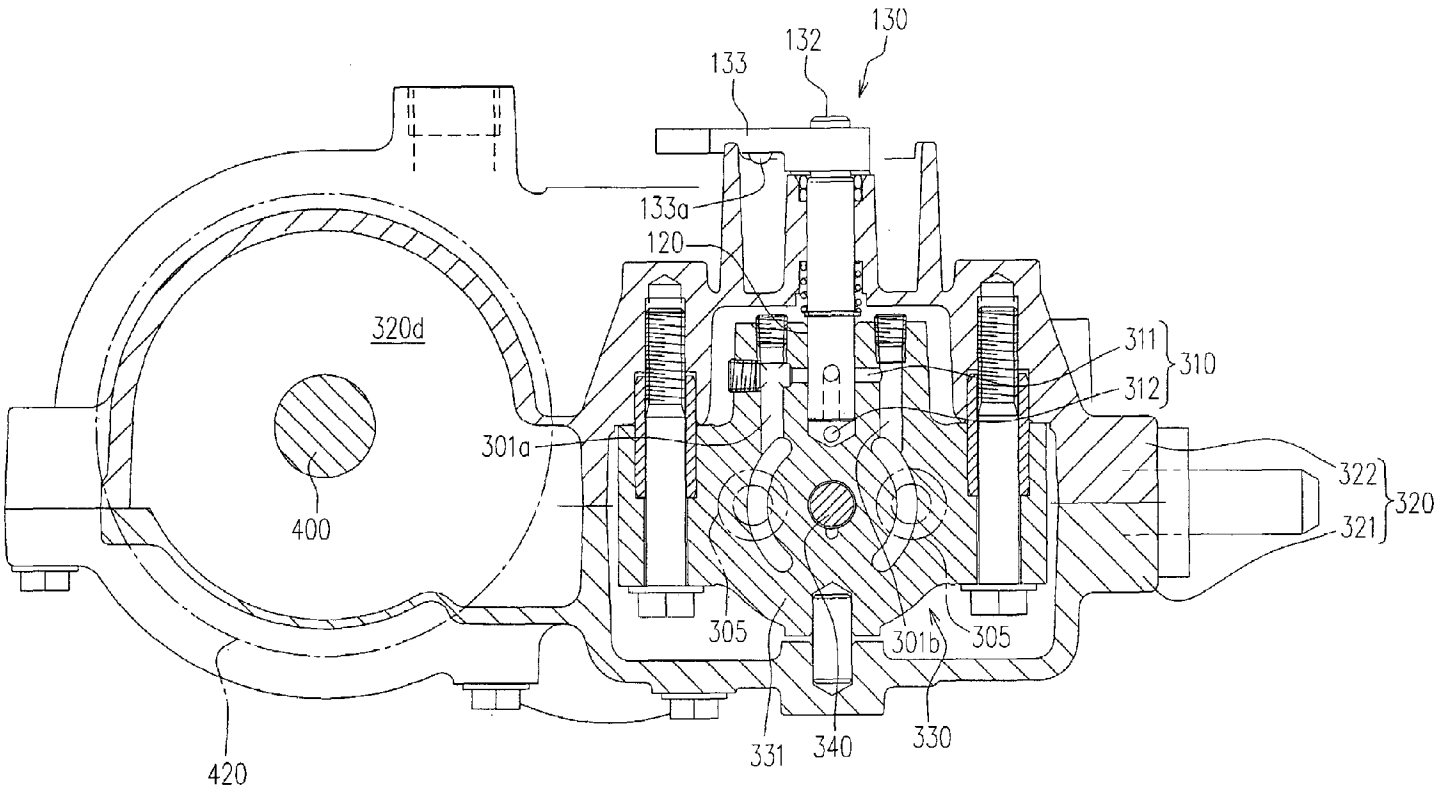
FIG. 15 is a cross-sectional view taken along a line XV-XV of FIG. 14.
Figure 16:
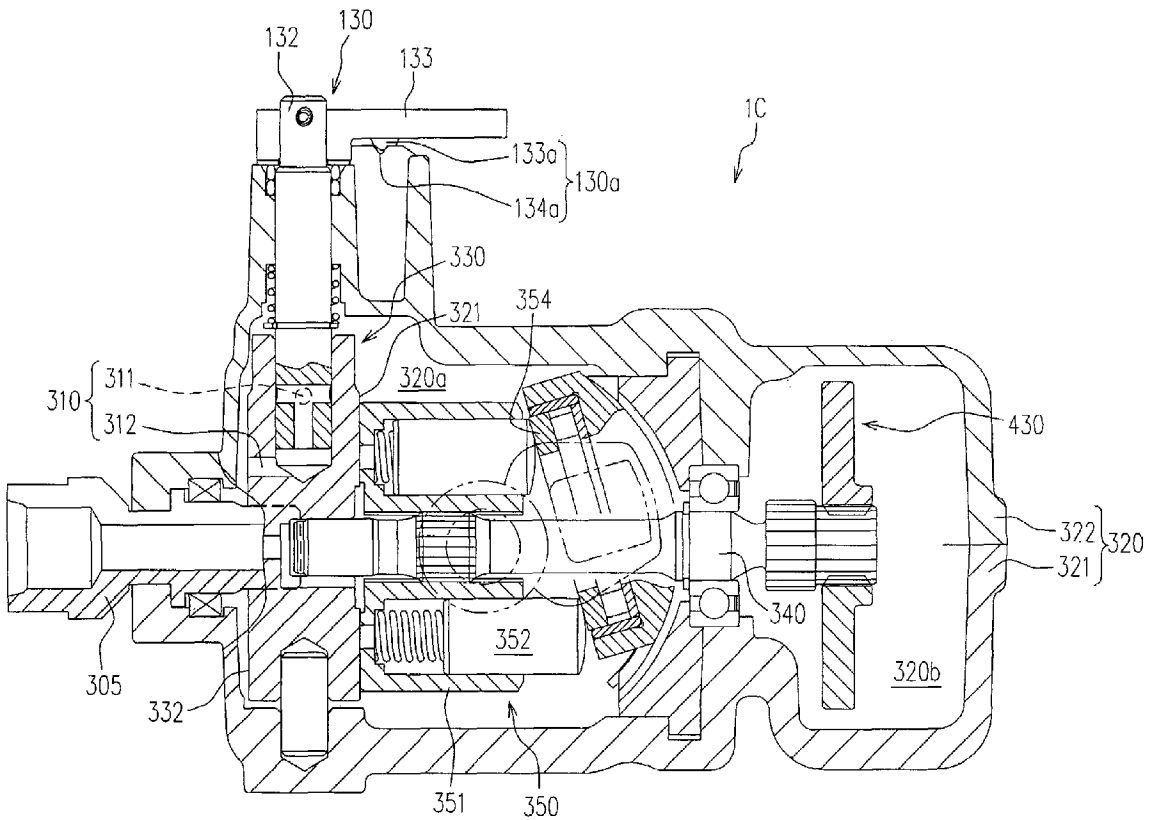
FIG. 16 is a cross-sectional view taken along a line XVI-XVI of FIG. 14.

FIG. 14 is a laterally partial plan view showing an axial piston device 1C according to this embodiment. Furthermore, FIGS. 15 and 16 are a cross-sectional view taken along a line XV-XV of FIG. 14 and a cross-sectional view taken along a line XVI-XVI of FIG. 14, respectively.

The axial piston device 1C according to this embodiment is configured to be used as a motor unit, unlike the first and second embodiments.

In other words, each of the axial piston devices 1, 1B according to the first and second embodiments includes the pump shaft 40 as the rotary shaft and the pump body 50 serving as the rotor rotatable together with the rotary shaft; in contrast, the axial piston device 1C according to this embodiment includes a motor shaft 340 as the rotary shaft and a motor body 350 serving as the rotor.

Specifically, the axial piston device 1C comprises the motor shaft 340, the motor body 350 including a cylinder block 351 fitted around in a non-rotatable manner relative to the motor shaft 340 and a plate 330 which is brought into contact with a discharge port and a suction port in the motor body 350. The motor block 351 is configured in such a manner as to be rotated with the application of an oil pressure from an oil source such as a hydraulic pump unit which is liquid-connected via the plate 330, thereby outputting rotational drive force from the motor shaft 340.

The axial piston device 1C according to this embodiment further comprises a housing 320 surrounding the motor body 350 and the plate 330, wherein its inside space serves as an oil sump.

As shown in FIGS. 14 to 16, an axle case for supporting a pair of drive axle shafts 400 for driving a pair of drive wheels is commonly used as the housing 320 in this embodiment.

That is to say, the axle case 320 includes first and second case bodies 321, 322 which are detachably connected to each other, so that a liquid-tight inside space can be defined by connecting the first and second case bodies 321, 322.

More particularly, the inside space of the axle case 320 is divided into a motor unit accommodating space 320*a* for accommodating therein the motor body 350 and the plate 330, a deceleration gear train accommodating space 320*b* for accommodating therein a deceleration gear train 410 operatively connected to the motor shaft 340, a differential gear unit accommodating space 320*c* for accommodating therein a differential gear unit 420 operatively connected to the deceleration gear train 410, and a drive axle shaft accommodating space 320*d* for accommodating therein a pair of drive axle shafts 400 operatively connected to the differential gear unit 420.

Incidentally, reference numeral 430 in FIG. 14 designates a brake mechanism capable of applying brake force to the motor shaft 340.

The motor shaft 340 has a base end supported by the plate 330 and a tip end supported on a partition wall of the axle case 320 in such a manner as to be exposed to the deceleration gear train accommodating space 320*b*.

The motor body 350 includes the cylinder block 351 fitted around in a non-rotatable manner relative to the motor shaft 340, a piston 352 accommodated inside the cylinder block 351 in a freely advancing/retreating manner in an axial direction, and a swash plate 354 defining an advancing/retreating range in the axial direction of the piston 352.

Here, the axial piston device 1C according to this embodiment is of a variable displacement type.

Consequently, the motor body 350 includes a movable swash plate serving as the swash plate 354. Furthermore, the motor body 350 includes a connecting arm 355 having a first end connected to the movable swash plate 354, and a control shaft 356 supported by the housing 320 in a rotatable manner about an axis so as to have a first end connected to a second end of the connecting arm 355 and a second end positioned outward of the housing 320.

As shown in FIG. 15, at the plate 330 are disposed a pair of oil passages 301*a*, 301*b* having first ends communicating with a discharge port and a suction port of the motor body 350, respectively, and a drain oil passage 310 for allowing the pair of oil passages 301*a*, 301*b* to communicate with the oil sump.

More particularly, as shown in FIG. 14, each first end of the pair of oil passages 301*a*, 301*b* is opened to a contact face 331 in contact with the motor body in outer surface of the plate 330.

Furthermore, each second end of the pair of oil passages 301*a*, 301*b* is opened to a back face 332 on a side opposite to the contact face 331.

As described above, the plate 330 is also surrounded by the housing 320 in this embodiment.

As a consequence, each second end of the pair of oil passages 301*a*, 301*b* is fluid-connected to a hydraulic source such as a hydraulic pump via a conduit member 305 supported by the housing 320 astride inward and outward of the housing 320 (see FIGS. 14 and 16).

The drain oil passage 310 has a first end communicating with at least one of the oil passages 301*a*, 301*b*, and a second end communicating with the oil sump (i.e., the inside space of the housing 320 in this embodiment).

According to this embodiment, the drain oil passage 310 includes a single cross oil passage 311 of a substantially linear shape for allowing the pair of oil passages 301*a*, 301*b* to communicate with each other, and a connecting oil passage 312 having a first end communicating with the cross oil passage 311 and a second end opened to the back face 332 of the plate 330, as shown in FIGS. 14 to 16.

Moreover, a disposing hole 120 is bored at the plate 330, like in the first and second embodiments and, further, a rotary valve 130 is inserted into the disposing hole 120 in a rotatable manner about an axis.

Incidentally, according to this embodiment, the outer end of the rotary valve 130 extends outward of the housing 320 (i.e., the axle case) such that the rotary valve 130 can be operated outward of the housing 320.

Additionally, a handle 133 is attached to an outward extending portion 132 at the rotary valve 130, like in the first and second embodiments.

As shown in FIGS. 15 and 16, a projection 133*a* is formed at the handle 133.

An engaging recess 134*a* formed is integrally with the housing 320. The projection 133*a* and the engaging recess 134*a* constitute a detent mechanism 130*a* for holding the rotary valve 130 at cutoff/communication positions.

This specification is by no means intended to restrict the present invention to the preferred embodiments set forth therein. Various modifications to the axial piston device may be made by those skilled in the art without departing from the spirit and scope of the present invention as defined in the appended claims.

The invention claimed is:

1. An axial piston device comprising:

(a) a housing including a housing body opened at a first end thereof and a plate disposed at the first end of the housing body;

(b) a rotary shaft rotatably supported about an axis by said housing body and said plate;

(c) a cylinder block rotated together with said rotary shaft, the cylinder block being accommodated inside said housing; and (d) a piston accommodated in said cylinder block in a slidable manner along an axial direction, wherein (e) said plate is provided with a pair of first oil passages having first ends fluidly connected to a discharge port and a suction port of said cylinder block and second ends opened to an outer surface of the plate, and a drain oil passage for fluidly connecting the pair of first oil passages to an internal space of the housing that functions as an oil sump, (f) said pair of first oil passages extends in a direction orthogonal to an axis line of the rotary shaft and are parallel to each other, sandwiching the rotary shaft therebetween, (g) said drain oil passage includes a single substantially linear cross oil passage that fluidly connects the pair of first oil passages, and a connecting oil passage having a first end fluidly connected to the cross oil passage and a second end opposite from the first end, (h) said plate is provided with a rotary valve which can selectively take a shutoff position at which the drain oil passage is shut off and a communication position at which the drain oil passage is communicated, and (i) the rotary valve is inserted in a rotatable manner around its axis line in a disposing hole that is formed in the plate so as to be positioned between the pair of first oil passages with and parallel thereto, and is configured so as to selectively take the shutoff position and the communication position by being rotated around its axis line without a movement along the axis line, (j) there is provided a valve plate between the plate and the cylinder block, the valve plate fluidly connecting the discharge port and the suction port of the cylinder block to the pair of first oil Passages, respectively, and supporting the cylinder block in a rotatable manner about the rotary shaft, (k) a surface of the plate that is faced to the internal space of the housing is formed with a groove that is opened toward the valve plate, (l) the second end of the connecting oil passage of the drain oil passage is fluidly connected to the groove, and (m) the groove extends further than the valve plate in a radial direction with the rotary shaft as a reference.

2. An axial piston device according to claim 1, further comprising:

a pump body to be driven by said rotary shaft; and a pair of second oil passages communicating with the discharge port and the suction port of said pump body, respectively, wherein at least a part of oil, which is supplied to a hydraulic device from the discharge port of said pump body via one of said second oil passages and is returned to the suction port of said pump body via the other one of said second oil passages, is introduced into said pair of first oil passages.

3. An axial piston device according to claim 1, wherein said housing is configured in such a manner as to surround said plate in addition to said cylinder block, and the second ends of said the pair of first oil passages are fluid-connected to a conduit member supported by the housing astride inward and outward of said housing.

* * * * *